US009482197B2

(12) United States Patent
Nishimura

(10) Patent No.: US 9,482,197 B2
(45) Date of Patent: Nov. 1, 2016

(54) FUEL SUPPLY STRUCTURE IN VEHICLE ENGINE

(71) Applicant: HONDA MOTOR CO., LTD., Tokyo (JP)

(72) Inventor: Shin Nishimura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 196 days.

(21) Appl. No.: 14/588,554

(22) Filed: Jan. 2, 2015

(65) Prior Publication Data

US 2015/0192097 A1 Jul. 9, 2015

(30) Foreign Application Priority Data

Jan. 8, 2014 (JP) ..... 2014-001925

(51) Int. Cl.

| | |
|---|---|
| ***F02M 55/02*** | (2006.01) |
| ***F02M 55/00*** | (2006.01) |
| ***F02M 35/02*** | (2006.01) |
| ***F02M 35/10*** | (2006.01) |
| ***F02M 35/024*** | (2006.01) |
| ***F02M 35/04*** | (2006.01) |
| *F02M 35/16* | (2006.01) |
| *F02B 61/02* | (2006.01) |

(52) U.S. Cl.

CPC ..... *F02M 55/02* (2013.01); *F02M 35/02* (2013.01); *F02M 35/0204* (2013.01); *F02M 35/024* (2013.01); *F02M 35/042* (2013.01); *F02M 35/10177* (2013.01); *F02M 35/10183* (2013.01); *F02M 35/10216* (2013.01); *F02M 55/004* (2013.01); *F02B 61/02* (2013.01); *F02M 35/162* (2013.01)

(58) Field of Classification Search

CPC ..... F02M 35/10216; F02M 35/10039; F02M 69/042

USPC ..... 123/431, 445, 468, 470; 180/219

See application file for complete search history.

(56) References Cited

U.S. PATENT DOCUMENTS

| | | | | |
|---|---|---|---|---|
| 7,082,927 | B2 * | 8/2006 | Miyashita | F02D 41/042 123/198 DB |
| 2004/0060545 | A1 * | 4/2004 | Kurayoshi | F02B 61/02 123/472 |
| 2004/0079340 | A1 * | 4/2004 | Matsuda | F02M 35/10032 123/472 |
| 2005/0205067 | A1 * | 9/2005 | Koide | F02M 35/10039 123/470 |
| 2008/0184961 | A1 * | 8/2008 | Miyashiro | F01N 13/20 123/445 |
| 2014/0318499 | A1 * | 10/2014 | Tanaka | F02D 41/30 123/478 |

FOREIGN PATENT DOCUMENTS

JP 4598838 B2 12/2010

* cited by examiner

*Primary Examiner* — Marguerite McMahon
*Assistant Examiner* — James Kim
(74) *Attorney, Agent, or Firm* — Squire Patton Boggs (US) LLP

(57) ABSTRACT

A main fuel injection valve and a secondary fuel injection valve are separately housed in a purified chamber and an unpurified chamber of an air cleaner. A common fuel supply conduit for leading fuel from a fuel tank is connected to a branching connection pipe which is supported to pass through a cleaner case and a bulkhead and which is placed in one of the unpurified chamber and the purified chamber 49. The branching connection pipe is connected to a main fuel injection valve side branched fuel conduit and a secondary fuel injection valve side branched fuel conduit.

18 Claims, 5 Drawing Sheets

FUEL SUPPLY STRUCTURE IN VEHICLE ENGINE

BACKGROUND

Field

The present invention relates to a vehicle engine which is provided with an air cleaner of the configuration that the interior of a cleaner case is divided into an unpurified chamber and a purified chamber by a bulkhead holding a cleaner element, a main fuel injection valve for injecting fuel into an intake passage that makes communication between an intake port provided in a cylinder head of an engine body and the purified chamber, and a secondary fuel injection valve for injecting fuel into the intake passage along a flow direction in the intake passage on an upper side in stream than the main fuel injection valve, and particularly, to an improvement in a fuel supply structure.

Description of the Related Art

As disclosed in JP Patent No. 4598838 (patent literature 1), there has already been known a vehicle engine in which fuel is enabled to be injected into an intake passage making communication between a purified chamber of an air cleaner and an intake port in a cylinder head, from a main fuel injection valve on a downstream side in a flow direction in the intake passage and from a secondary fuel injection valve on an upstream side in the flow direction.

In patent literature 1, a main fuel injection valve is attached to a throttle body arranged outside the air cleaner, while the secondary fuel injection valve is housed in the air cleaner or attached to the air cleaner from the outside of the same, to reduce restrictions on the freedom in piping fuel pipes to the main fuel injection valve and the secondary fuel injection valve. However, where the air cleaner is configured to be large in order to accommodate required capacity, the main fuel injection valve and the secondary fuel injection valve are housed together with the throttle body and the like in the air cleaner. This can help avoid a dimensional increase of an intake device that would result from securing, outside the air cleaner, the space required to arrange parts forming the air passage such as the throttle body and the like, the main fuel injection valve and the secondary fuel injection valve. In this case, it is desirable that the fuel piping for supplying fuel to the main fuel injection valve and the secondary fuel injection valve be of the structure which decrease the number of required parts, and which can be arranged in an air cleaner having a spatial restriction.

SUMMARY

The present invention has been achieved in view of the above-mentioned circumstances, and an object of the present invention is to provide a fuel supply structure in a vehicle engine wherein fuel piping to a main fuel injection valve and a secondary fuel injection valve that are housed in an air cleaner can be arranged in a simplified structure having parts decreased in number.

To attain the above-mentioned object, a vehicle engine can be provided with an air cleaner configured to be divided in a cleaner case by a bulkhead holding a cleaner element into an unpurified chamber and a purified chamber. A main fuel injection valve is provided, for injecting fuel into an intake passage that makes communication between an intake port provided on a cylinder head in an engine body and the purified chamber. A secondary fuel injection valve is provided, for injecting fuel into the intake passage on an upper side in stream than the main fuel injection valve in a flow direction in the intake passage. A first feature of the invention resides in that one of the main fuel injection valve and the secondary fuel injection valve is housed in the purified chamber. The other of the main fuel injection valve and the secondary fuel injection valve is housed in the unpurified chamber. A common fuel supply conduit for leading fuel from a fuel tank to the main fuel injection valve and the secondary fuel injection valve in common is connected to a branching connection pipe which is supported to pass through the cleaner case and the bulkhead and which is placed in one of the unpurified chamber and the purified chamber. The branching connection pipe is connected to a main fuel injection valve side branched fuel conduit for leading fuel toward the main fuel injection valve side and to a secondary fuel injection valve side branched fuel conduit for leading fuel toward the secondary fuel injection valve side.

A second feature of the invention resides in that the branching connection pipe having a pair of branched pipe portions is placed in the unpurified chamber and that one of both of the branched pipe portions passes through the bulkhead and is supported by the bulkhead to open on the purified chamber side.

A third feature of the invention resides in that a lower case half body and an upper case half body are dividable vertically and are combined to constitute the cleaner case, and the branching connection pipe which is arranged in the unpurified chamber defined between the bulkhead and the lower case half body passes through the lower case half body, and is connected to the common fuel supply conduit.

A fourth feature of the invention resides in that the branched pipe portion on one side possessed by the branching connection pipe and opening on the purified chamber side is connected by a quick connector to the branched fuel conduit which, of the main fuel injection valve side branched fuel conduit and the secondary fuel injection valve side branched fuel conduit, is arranged in the purified chamber.

A fifth feature of the invention resides in that annular elastic seal members are respectively interposed between the branching connection pipe, and the cleaner case and the bulkhead.

A sixth feature of the invention resides in that at least a part of the intake passage making communication between the purified chamber and the intake port is formed by an air funnel opening to the purified chamber and a throttle body arranged in the unpurified chamber and connected to a downstream end part of the air funnel.

A seventh feature of the invention resides in that the throttle bodies separated in a vehicle front-rear direction are arranged in the unpurified chamber with themselves mutually coupled by a bracket arranged on a lateral side of the throttle bodies. A joint member connects the main fuel injection valve side branched fuel conduit to a main fuel injection valve side fuel supply pipe, and is connected to the main fuel injection valves respectively annexed to the throttle bodies is arranged to pass through the bracket.

An eighth feature of the invention resides in that the bracket has a connecting plate portion which is fastened to the throttle bodies separated in the vehicle front-rear direction and which is provided with a perforated aperture making the joint member pass therethrough. A first boss portion is arranged on the throttle bodies side with respect to the connecting plate portion and is consecutively connected to either one of front and rear parts of the connecting plate portion to be fastened to a lower part of the cleaner case. A second boss portion is arranged on an opposite side to the throttle bodies with respect to the connecting plate portion and is consecutively connected to the other of the front and rear parts of the connecting plate portion to be fastened to a lower part of the cleaner case. The joint member and the first boss portion are arranged to overlap partly at least as viewed in a plan view.

A ninth feature of the invention resides in that the branching connection pipe is placed at such a position where, as viewed laterally, it overlaps a part of the the throttle body on a rear side of the throttle bodies separated in the vehicle front-rear direction. An electric motor is provided, for generating a power to drivingly turn throttle valves respectively provided in the throttle bodies, and is housed in the unpurified chamber to be placed ahead of the throttle body on a front side of the throttle bodies separated in the vehicle front-rear direction.

According to the first feature of the present invention, the main fuel injection valve and the secondary fuel injection valve are separately housed in the purified chamber and the unpurified chamber of the air cleaner. The common fuel supply conduit is in common to the main fuel injection valve, and the secondary fuel injection valve is connected to the branching connection pipe which is placed in one of the unpurified chamber and the purified chamber and which is supported to pass through the cleaner case and the bulkhead. The branching connection pipe is connected to the main fuel injection valve side branched fuel conduit and the secondary fuel injection valve side branched fuel conduit. Thus, the fuel piping can be simplified by containing in the air cleaner the branching connection pipe that distributes fuel to the main fuel injection valve and the secondary fuel injection valve. A decrease in the number of parts can be realized by making unnecessary fastening members or the like that secure the branching connection pipe to the cleaner case. Also, performing machining to form fastening portions on the cleaner case and the branching connection pipe becomes unnecessary, whereby the manpower and cost of machining can be decreased.

Further, according to the second feature of the present invention, one of the paired branched pipe portions which the branching connection pipe placed in the unpurified chamber passes through the bulkhead and is supported by the bulkhead to open on the purified chamber side. Thus, it is unnecessary to perform the machining for the fuel piping connection at a part on the purified chamber side of the cleaner case, and this contributes to securing the airtightness of the purified chamber.

According to the third feature of the present invention, since the branching connection pipe placed in the unpurified chamber passes through the lower case half body that constitutes the cleaner case in cooperation with the upper case half body and that defines the unpurified chamber between itself and the bulkhead, it is unnecessary to perform machining for fuel piping connection at a part on the purified chamber side of the cleaner case. This contributes to securing the airtightness of the purified chamber.

According to the fourth feature of the present invention, the branched pipe portion which, of the pair of branched pipe portions possessed by the branching connection pipe, opens on the purified chamber side is connected by the quick connector to the branched fuel conduit which, of the main fuel injection valve side branched fuel conduit and the secondary fuel injection valve side branched fuel conduit, is disposed in the purified chamber. Thus, at the time of assembling the air cleaner, a tool is not required in connecting the branched pipe portion opening on the purified chamber side to the branched fuel conduit placed in the purified chamber, so that the interior of the purified chamber can be prevented from becoming dirty.

According to the fifth feature of the present invention, since the branching connection pipe is supported by the cleaner case and the bulkhead through the annular elastic seal members, the sealing performance at the portions where the branching connection pipe passes through can be ensured. Furthermore, the pulsation in fuel pressure can be prevented from being transmitted from the branching connection pipe to the cleaner case, so that the generation of vibration at the cleaner case can be suppressed.

According to the sixth feature of the present invention, since the throttle body constituting at least a part of the intake passage is disposed in the unpurified chamber, a required capacity of the air cleaner can be secured by arranging in the unpurified chamber movable members such as the throttle valve urged in the throttle bodies. This contributes to downsizing the whole of the intake device extending from the air cleaner to the cylinder head.

According to the seventh feature of the present invention, the joint member which connects the main fuel injection valve side fuel supply pipe and the main fuel injection valve side branched fuel conduit passes through the bracket mutually coupling the throttle bodies separated in the front-rear direction. The main fuel injection valve side fuel supply pipe is connected to main fuel injection valves respectively annexed to the throttle bodies. This makes it easy to perform the connection and separation between the main fuel injection valve side fuel supply pipe and the main fuel injection valve side branched fuel conduit at the time of assembling and disassembling, and hence, contributes to simplifying the fuel piping.

According to the eighth feature of the present invention, the first boss portion, constituting a part of the bracket and fastened to the lower part of the cleaner case by a fastening operation from under the cleaner case, and the joint member are arranged to overlap each other partly at least as viewed in the plan view. Thus, the region occupied by the first boss portion and the region occupied by the joint member are piled up vertically. This makes it possible to avoid an increase in dimension of the cleaner case and at the same time, to secure the space required for performing the fastening operation of the first boss portion to the cleaner case.

According to the ninth feature of the present invention, the branching connection pipe, as viewed in the lateral direction, overlaps a part of the throttle body on the rear side of the throttle bodies separated in the front-rear direction. The electric motor for generating the power to drivingly turn the throttle valves is located ahead of the throttle body on the front side of the throttle bodies separated in the front-rear direction. Thus, it can be avoided that the air cleaner housing the fuel supply device increases in dimension.

DETAILED DESCRIPTION

Embodiments according to the present invention will be described with reference to the accompanying drawings. It is to be noted that, throughout the following description, front-rear, upward-downward and right-left will be referred to as those directions viewed by a rider of a motorcycle.

Figure 1:
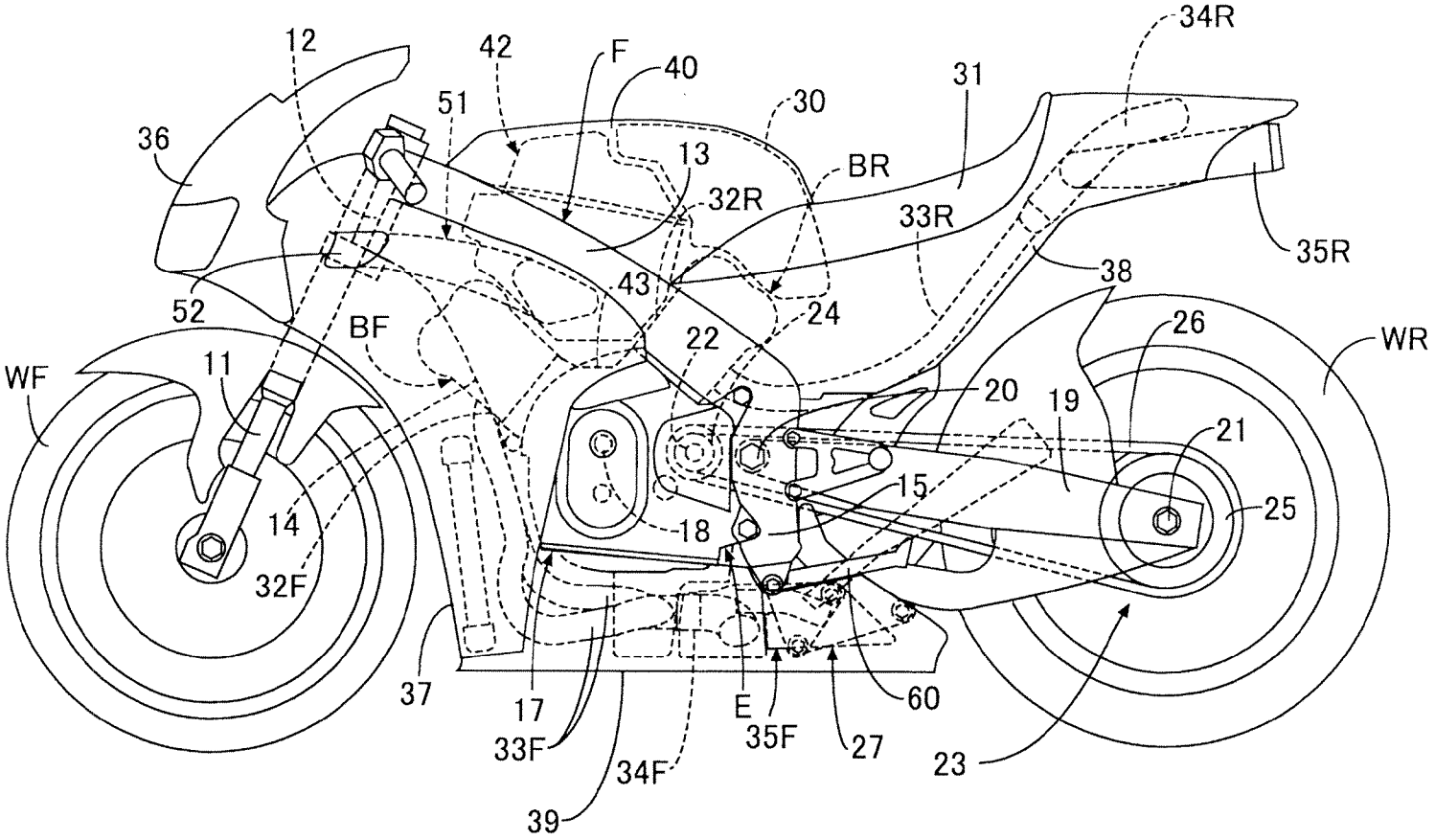
FIG. 1 is a left side view of a motorcycle.

In FIG. 1, a body frame F of a motorcycle being a saddle-ride type vehicle is provided with a head pipe 12 steerably supporting a front fork 11 to which a front wheel WF is journaled. A pair of right and left main frames 13 extend downward toward the rear from the head pipe 12, and a pair of right and left engine hangers 14 are welded to the head pipe 12 and front parts of both the main frames 13 and extending downward from the main frames 13. A pair of right and left pivot frames 15 extend downward from the rear parts of the main frames 13.

The body frame F is equipped with an engine body 17 of, for example, a V-type engine E constituted by four cylinders. In this embodiment, the engine body 17 is supported by lower parts of the pair of engine hangers 14, intermediate parts of the main frames 13 and upper parts and lower parts of the pair of pivot frames 15 so that a crankshaft 18 extending in a vehicle width direction is rotatably supported. The engine body 17 has a front bank BF and a rear bank BR arranged to take a V-shape. Each bank has two cylinders aligned in an axial direction of the crankshaft 18.

Vertically intermediate parts of the pair of pivot frames 15 swingably support a front end part of a swing arm 19 through a spindle 20. An axle 21 for a rear wheel WR is rotatably supported to a rear end part of the swing arm 19.

Power from an output shaft 22 of a transmission incorporated in the engine body 17 is transmitted to the rear wheel WR through chain transmission means 23. Chain transmission means 23 is composed of a drive sprocket 24 fixed on the output shaft 22, a driven sprocket 25 fixed on the axle 21 for the rear wheel WR, and an endless chain 26 wound around these sprockets 24, 25.

A front part of the swing arm 19 is coupled to lower parts of the pair of pivot frames 15 through a link mechanism 27. A rear cushion unit (not shown) is provided between a member constituting a part of the link mechanism 27 and the rear parts of the main frames 13.

Over the rear bank BR in the engine body 17, a fuel tank 30 is supported by the main frames 13. Riding seat 31 is arranged behind the fuel tank 30, and is supported at the rear parts of the body frames F.

A pair of front bank side discrete exhaust pipes 33F that communicate on a cylinder-by-cylinder basis with cylinder heads 32F of the front bank BF in the engine body 17 is extended rearward through under the engine body 17 and is connected in common to a front bank side exhaust manifold 34F. The front bank side exhaust manifold 34F is connected to a front bank side exhaust muffler 35F arranged behind and under the engine body 17. A pair of rear bank side discrete exhaust pipes 33R that communicate on a cylinder-by-cylinder basis with cylinder heads 32R of the rear bank BR in the engine body 17 and that extend rearward is connected to a rear bank side exhaust manifold 34R behind the riding seat 31. The rear bank side exhaust manifold 34R is connected to a rear bank side exhaust muffler 35R arranged over the rear wheel WR.

The head pipe 12 in the body frame F is covered by a front cowl 36 from the front side thereof. The front part of the body frame F and a part of the engine body 17 are covered by a pair of right and left center cowls 37 from the lateral sides. The rear part of the body frame F, the rear bank side discrete exhaust pipes 33R, the rear bank side exhaust manifold 34R, and the rear bank side exhaust muffler 35R are covered by a rear cowl 38 so that a rear part of the rear bank side exhaust muffler 35R protrudes rearward. Further, a part of the front bank side discrete exhaust pipes 33F, the front bank side exhaust manifold 34F, and the front bank side exhaust muffler 35F are covered by an under cowl 39 whose front end part is consecutively connected to a lower part of the center cowl 37, from the lower side and both the lateral sides.

Over the engine body 17 and ahead of the fuel tank 30, a single air cleaner 42 common to the front bank BF and the rear bank BR is arranged so as to be partly received in a hollow 43 between the front bank BF and the rear bank BR and to be put between the pair of right and left main frames 13 constituting a part of the body frame F, and the air cleaner 42, together with fuel tank 30, is covered by a cover 40.

Figure 2:
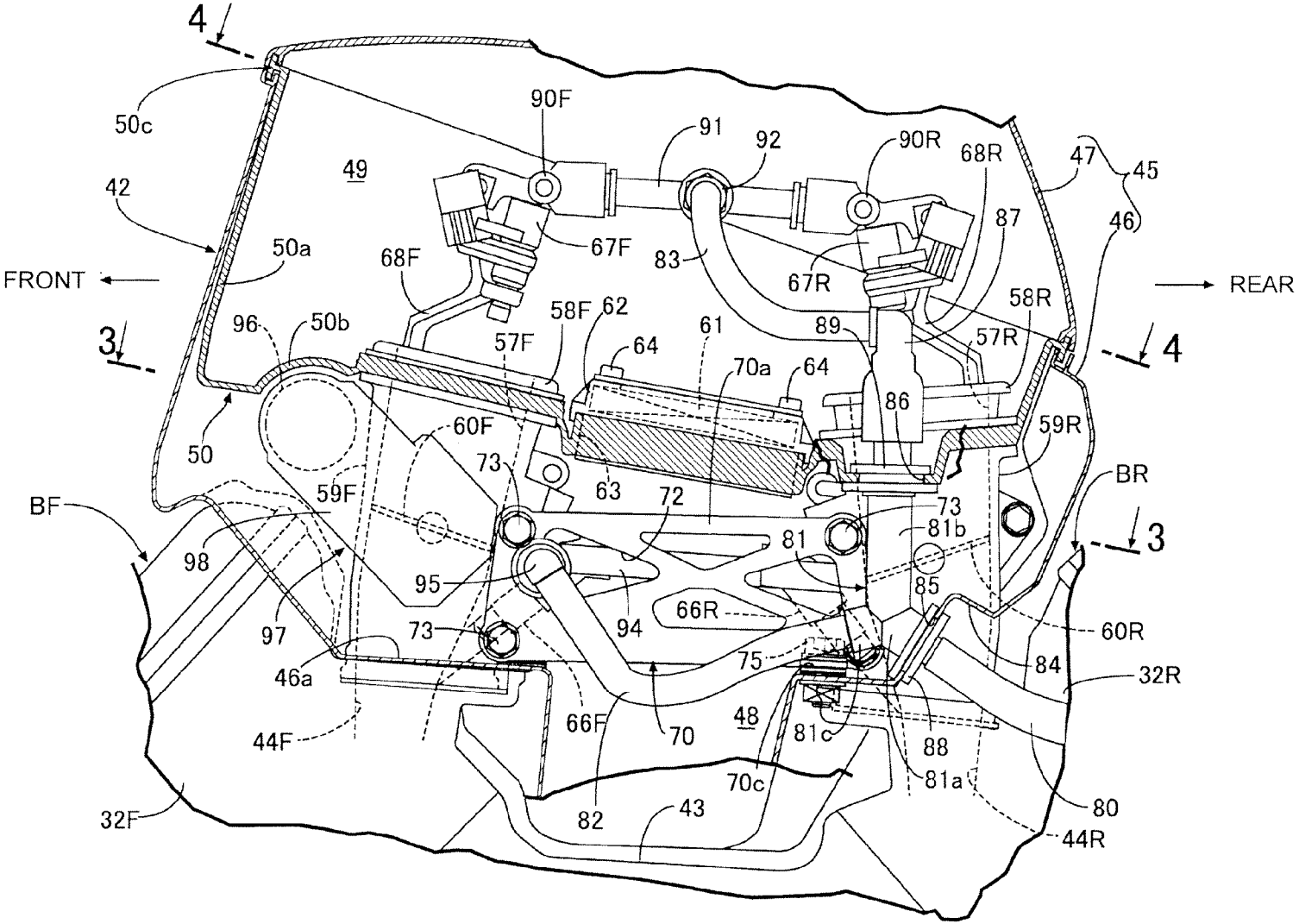
FIG. 2 is a longitudinal sectional view of an essential part of an engine.

Also referring to FIG. 2, in sidewalls of the cylinder heads 32F, 32R, facing the hollow 43 between the front and rear banks BF, BR of the engine body 17, intake ports 44F, 44R discretely corresponding to two pair of cylinders are provided to extend vertically.

A cleaner case 45 of the air cleaner 42 is constructed by mutually combining a lower case half body 46 and an upper case half body 47 which are dividable in the vertical direction. The upper case half body 47 is combined with an upper end part of the lower case half body 46 so as to close an upper end opening of the lower case half body 46 that is formed like an upward opening box. A bulkhead 50 dividing the interior of the cleaner case 45 into a lower unpurified chamber 48 and an upper purified chamber 49 is put between the lower case half body 46 and the upper case half body 47.

The bulkhead 50 integrally has a cylindrical sidewall portion 50*a* that, from inside, comes close to and faces an internal surface of an upper sidewall in the lower case half body 46 of the cleaner case 45. A bottom board portion 50*b* consecutively connected to a lower end of the sidewall portion 50*a*, and a sandwiched portion 50*c* taking an almost T-shape in cross-section and protruding outward from an upper end of the sidewall portion 50*a*. The sandwiched portion 50*c* is put between the upper end portion of the lower case half body 46 and the lower end portion of the upper case half body 47.

Figure 3:
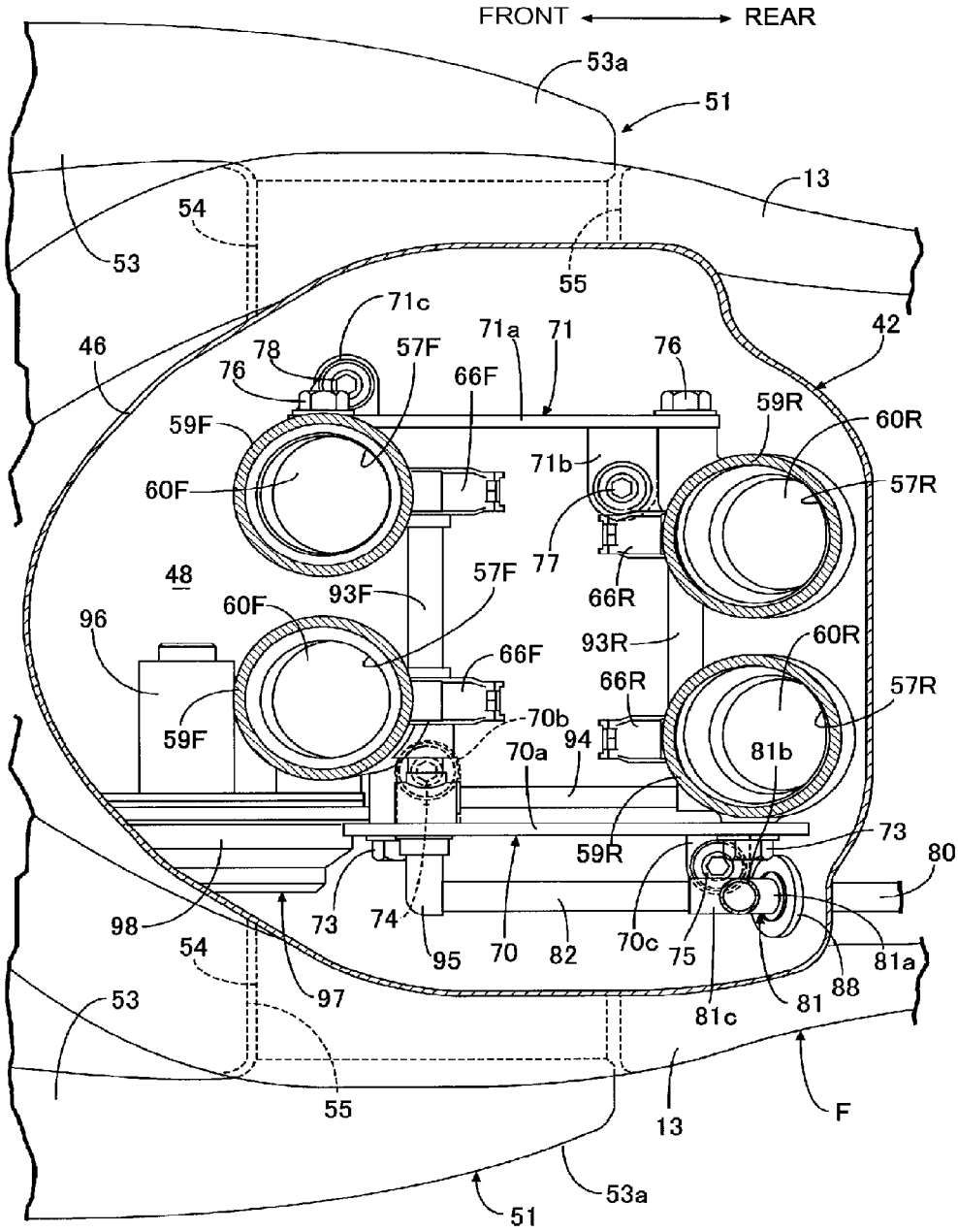
FIG. 3 is a sectional view taken along line 3-3 in FIG. 2.
Figure 4:
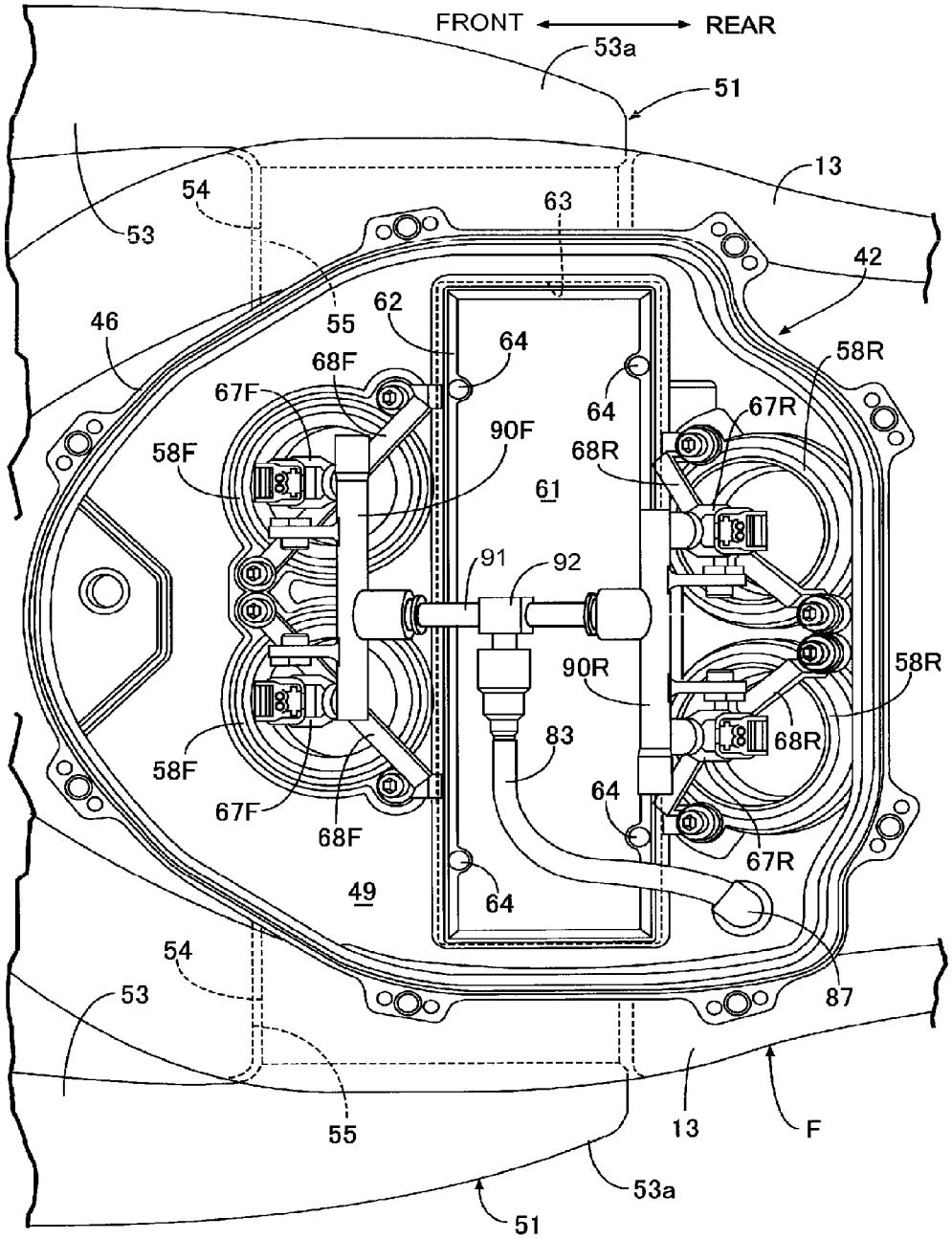
FIG. 4 is a view from an arrow direction, taken along line 4-4 in FIG. 2 in the state that an upper case half body is omitted.

Also referring to FIG. 3 and FIG. 4, outside air lead means for leading the outside air to the unpurified chamber 48 are connected respectively to both side portions in the vehicle width direction of the lower case half body 46 in the cleaner case 45 of the air cleaner 42.

The outside air lead means 51 are provided with intake ducts 53 that extend in the vehicle front-rear direction to communicate with outside air intake ports 52 (refer to FIG. 1) provided in front side surfaces of the center cowl 37. Ducts 53 have bents 53*a* at rear end portions for turning the intake direction from the vehicle front-rear direction to the vehicle width direction. Connecting tubes 54 made of an elastic material make connection between the bents 53*a* and the lower case half body 46.

Figure 5:
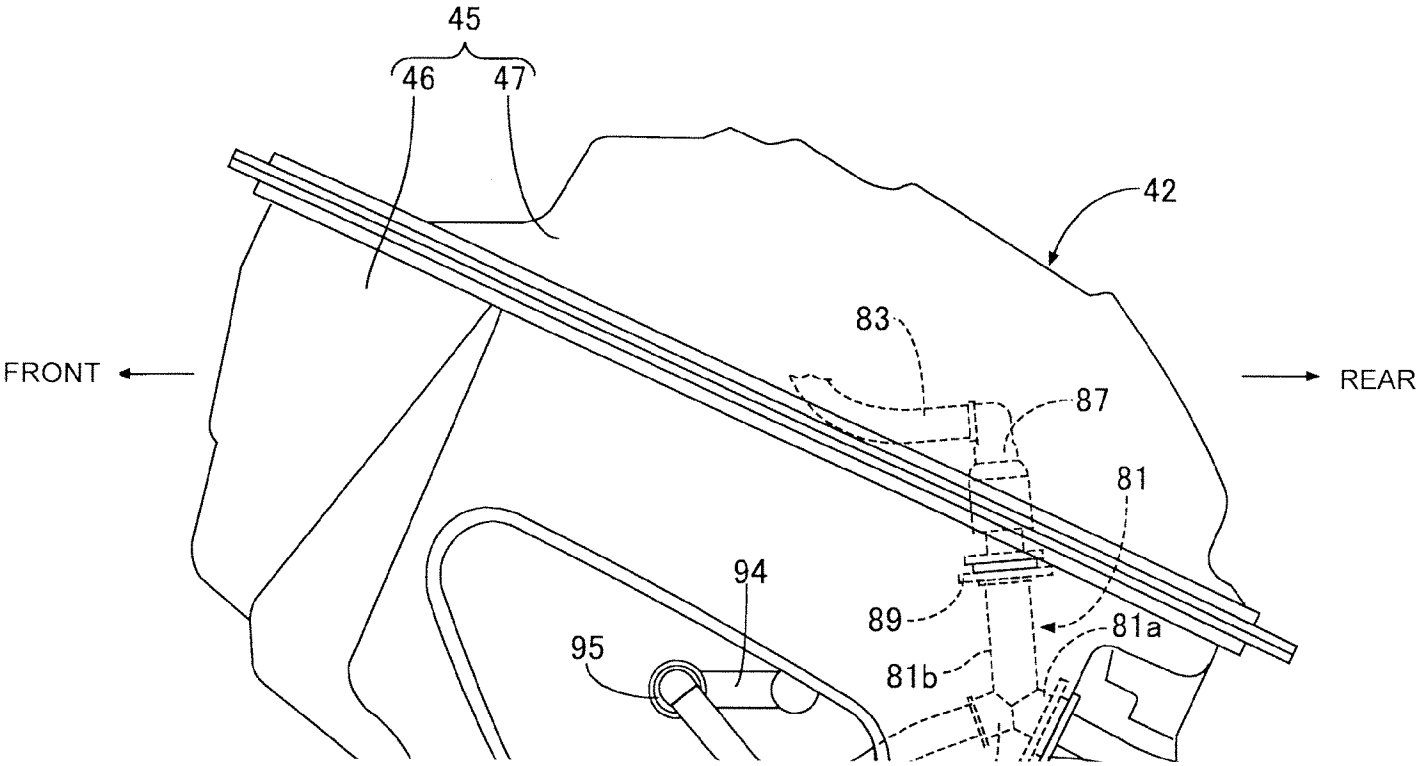
FIG. 5 is a side view of an air cleaner as viewed in the same direction as in FIG. 2.

Most parts of the intake ducts 53 are arranged to extend in the front-rear direction on the outer sides of the main frames 13. Upstream end portions of the connecting tubes 54 inserted into through holes 55 that are provided in the main frames 13 in correspondence to the bents 53*a* at the rear end portions of the intake ducts 53 are connected to the bents 53*a*. As shown in FIG. 5, the lower case half body 46 in the cleaner case 45 of the air cleaner 42 is provided with connection holes 56 at the side portions on both sides in the vehicle width direction. Downstream end portions of the connecting tubes 54 are fitted and connected to the connection holes 56, so that the outside air led by the outside air lead means 51 is introduced to the unpurified chamber 48 of the air cleaner 42.

At least some of intake passages 57F that make communication between the intake ports 44F for respective cylinders in the cylinder head 32F of the front bank BF and the purified chamber 49 are formed by air funnels 58F opening to the purified chamber 49 and throttle bodies 59F arranged in the unpurified chamber 48 and connected to the downstream end parts of the air funnels 58F. In this embodiment, the intake passages 57F are formed by the air funnels 58F and the throttle bodies 59F. Further, at least some of intake passages 57R that make communication between the intake ports 44R for respective cylinders in the cylinder head 32R of the rear bank BR and the purified chamber 49 are formed by air funnels 58R opening to the purified chamber 49 and throttle bodies 59R arranged in the unpurified chamber 48 and connected to the downstream end parts of the air funnels 58R. In this embodiment, the intake passages 57R are formed by the air funnels 58R and the throttle bodies 59R.

The throttle bodies 59F, 59R pass through the bottom wall 46*a* of the lower case half body 46 to be airtightly connected to the cylinder heads 32F, 32R. In addition, the throttle bodies 59F, 59R standing connected to the cylinder heads 32F, 32R are tilted to come close mutually as they go upward, and throttle valves 60F, 60R for controlling the opening degree of the intake passages 57F, 57R are pivotably journaled to the throttle bodies 59F, 59R.

The air funnels 58F, 58R which are so connected as to fit the lower end portions in the upper end portions of the throttle bodies 59F, 59R are fitted in the bottom board portion 50*b* of the bulkhead 50 with the upper ends opening to the purified chamber 49.

In the air cleaner 42, a cleaner element 61 is located between the throttle bodies 59F, 59R separated in the vehicle front-rear direction. The cleaner element 61 takes a rectangular shape and is held in an element support frame 62. The bottom board portion 50*b* of the bulkhead 50 is provided with a rectangular opening 63 that is long in the vehicle width direction to be arranged between the air funnels 58F and the throttle bodies 59F on the front bank BF side and the air funnels 58R and the throttle bodies 59R on the rear bank BR side. The element support frame 62 partly fitted in the opening 63 is fastened to the bottom board portion 50*b* of the bulkhead 50 by a plurality of bolts 64 with the cleaner element 61 closing the opening 63.

That is, the cleaner element 61 takes a rectangular shape and is disposed in the air cleaner 42 between the throttle bodies 59F on the front bank BF side and the throttle bodies 59R on the rear bank BR side to be held by the bulkhead 50, with its longitudinal direction kept in parallel to the axis of the crankshaft 18 extending in the vehicle width direction. Thus, the outside air introduced to the unpurified chamber 48 passes through the cleaner element 61 upward to be led to the purified chamber 49, and the air purified by the cleaner element 61 turns around downward from the purified chamber 49 to be introduced from the upper ends of the air funnels 58F, 58R to the intake ports 44F, 44R through the intake passages 57F, 57R.

Fuel is injected from main fuel injection valves 66F, 66R into the intake passages 57F, 57R. On an upper side relative to the main fuel injection valves 66F, 66R in the flow direction of the intake passages 57F, 57R, fuel is injected from secondary fuel injection valves 67F, 67R into the intake passages 57F, 57R. One of the main fuel injection valves 66F, 66R and the secondary fuel injection valves 67F, 67R, (that is, the secondary fuel injection valves 67F, 67R in this embodiment) are housed in the purified chamber 49, while the other of the main fuel injection valves 66F, 66R and the secondary fuel injection valves 67F, 67R, (that is, the main fuel injection valves 66F, 66R in this embodiment) are housed in the unpurified chamber 48 to be attached to the throttle bodies 59F, 59F.

The secondary fuel injection valves 67F on the front bank BF side are supported by valve support frames 68F which are attached to the bottom board portion 50*b* of the bulkhead 50 to stretch over the air funnels 58F, and the secondary fuel injection valves 67R on the rear bank BR side are supported by valve support frames 68R which are attached to the bottom board portion 50*b* of the bulkhead 50 to stretch over the air funnels 58R.

The pair of throttle bodies 59F on the front bank BF side and the pair of throttle bodies 59R on the rear bank BR side are arranged in the unpurified chamber 48 separately in the vehicle front-rear direction. However, the throttle bodies 59F, 59R on the left side in the vehicle width direction are mutually coupled by a left bracket 70 arranged on the left side of these throttle bodies 59F, 59R, while the throttle bodies 59F, 59R on the right side in the vehicle width direction are mutually coupled by a right bracket 71 arranged on the right side of these throttle bodies 59F, 59R.

The bracket 70 on the left side has a connecting plate portion 70*a* that is fastened to the throttle bodies 59F, 59R separated in the vehicle front-rear direction on the left side in the vehicle width direction. A first boss portion 70*b* is arranged on the throttle bodies 59F, 59R side with respect to the connecting plate portion 70*a* and is consecutively connected to either one of the front and rear parts of the connecting plate portion 70*a* (to the front part in this embodiment) to be fastened to a lower part of the cleaner case 45. A second boss portion 70*c* is arranged on the opposite side to the throttle bodies 59F, 59R with respect to the connecting plate portion 70*a* and is consecutively connected to the other of the front and rear parts of the connecting plate portion 70*a* (to the rear part in this embodiment) to be fastened to a lower part of the cleaner case 45.

Both of the front and rear end parts of the connecting plate portion 70*a* are fastened by two sets of bolts 73. Each set includes a pair separated vertically, to the throttle bodies 59F, 59R on the left side in the vehicle width direction. Further, the first boss portion 70*b* is fastened by a bolt 74 to the bottom wall 46*a* of the lower case half body 46 in the cleaner case 45, and the second boss portion 70*c* is fastened by a bolt 75 to the bottom wall 46*a*.

The bracket 71 on the right side has a connecting plate portion 71*a* that is fastened to the throttle bodies 59F, 59R separated in the vehicle front-rear direction on the right side in the vehicle width direction. A third boss portion 71*b* is arranged on the throttle bodies 59F, 59R side with respect to the connecting plate portion 71*a* and that is consecutively connected to either one of the front and rear parts of the connecting plate portion 71*a* (to the rear part in this embodiment) to be fastened to a lower part of the cleaner case 45. A fourth boss portion 71*c* is arranged on the opposite side to the throttle bodies 59F, 59R with respect to the connecting plate portion 71*a* and is consecutively connected to the other of the front and rear parts of the connecting plate portion 71*a* (to the front part in this embodiment) to be fastened to a lower part of the cleaner case 45.

Both of the front and rear end parts of the connecting plate portion 71*a* are fastened by two sets of bolts 76. Each set includes a pair separated vertically, to the throttle bodies 59F, 59R on the right side in the vehicle width direction. Further, the third boss portion 71*b* is fastened by a bolt 77 to the bottom wall 46*a* of the lower case half body 46 in the cleaner case 45, and the fourth boss portion 71*c* is fastened by a bolt 78 to the bottom wall 46*a*.

The connecting plate portion 70*a* of the bracket 70 on the left side is provided with a plurality of perforated apertures 72 as clearly shown in FIG. 2. The connecting plate portion 71*a* of the bracket 71 on the right side is also provided with a plurality of perforated apertures though the same are not shown in the drawings.

A common fuel supply hose 80 as a common fuel supply conduit for leading fuel from the fuel tank 30 to the main fuel injection valves 66F, 66R and the secondary fuel injection valves 67F, 67R in common is extended toward the left-rear portion of the lower case half body 46 in the cleaner case 45. The common fuel supply hose 80 is connected to a branching connection pipe 81 which is supported to pass through the cleaner case 45 and the bulkhead 50 and which is placed in the unpurified chamber 48 being one of the unpurified chamber 48 and the purified chamber 49. To the branching connection pipe 81, there are connected a main fuel injection valve side branched fuel hose 82 being a main fuel injection valve side branched fuel conduit for leading fuel toward the main fuel injection valves 66F, 66R side, and a secondary fuel injection valve side branched fuel hose 83 being a secondary fuel injection valve side branched fuel conduit for leading fuel toward the secondary fuel injection valves 67F, 67R side.

The branching connection pipe 81 takes an almost Y-letter shape having a common pipe portion 81*a* connected to the common fuel supply hose 80 and a pair of branched pipe portions 81*b*, 81*c* branched from the common pipe portion 81*a*. In the branching connection pipe 81 in this embodiment, the common pipe portion 81*a* passes through the lower case half body 46 and is supported to the lower case half body 46 to be disposed in the unpurified chamber 48 on the left side of the connecting plate portion 70*a* of the left bracket 70. One 81*b* of both of the branched pipe portions 81*b*, 81*c* passes through the bottom board portion 50*b* of the bulkhead 50 and is supported by the bottom board portion 50*b* to open on the purified chamber 49 side.

In addition, the branching connection pipe 81 is placed at such a position where, as viewed laterally, it overlaps some of the throttle bodies 59R on the rear side of the throttle bodies 59F and the throttle bodies 59R separated in the vehicle front-rear direction.

The lower case half body 46 is formed at its left-rear part with a recess 84 opening leftward and rearward. The common pipe portion 81*a* of the branching connection pipe 81 passes through a support hole 85 provided on the lower case half body 46 and is arranged to make its end portion reach the recess 84. The common fuel supply hose 80 is connected to the end portion of the common pipe portion 81*a* in the recess 84.

The branched pipe portion 81*b* on one side that the branching connection pipe 81 has to open on the purified chamber 49 side is arranged to pass through a support hole 86 provided in the bottom board portion 50*b* of the bulkhead 50 and to make an end portion open to the purified chamber 49. The end portion of the branched pipe portion 81*b* is connected by a quick connector 87 to the secondary fuel injection valve side branched fuel hose 83 which, of the main fuel injection valve side branched fuel hose 82 and the secondary fuel injection valve side branched fuel hose 83, is placed in the purified chamber 49.

Annular elastic seal members are respectively interposed between the branching connection pipe 81, and the lower case half body 46 of the cleaner case 45 and the bulkhead 50. In this embodiment, a grommet 88 as the annular elastic seal member is fitted around the support hole 85 to enable the common pipe portion 81*a* to pass therethrough airtightly, while a grommet 89 as the annular elastic seal member is fitted around the support hole 86 to enable the branched pipe portion 81*b* to pass therethrough airtightly.

Referring now to FIG. 2 and FIG. 4 in particular, a common fuel supply pipe 91 is connected to a fuel supply pipe 90F that extends in the purified chamber 49 in the vehicle width direction to be connected to the pair of secondary fuel injection valves 67F aligned in the vehicle width direction on the front bank BF side, and to a fuel supply pipe 90R that extends in the purified chamber 49 in the vehicle width direction to be connected to the pair of secondary fuel injection valves 67R aligned in the vehicle width direction on the rear bank BR side. The secondary fuel injection valve side branched fuel hose 83 is connected to a center portion of the common fuel supply pipe 91 through a connecting pipe member 92.

Referring now to FIG. 3, between the throttle bodies 59F aligned in the vehicle width direction on the front bank BF side, there is provided a communication pipe 93F that extends in the vehicle width direction to make communication of the main fuel injection valves 66F annexed to the throttle bodies 59F. Between the throttle bodies 59R aligned in the vehicle width direction on the rear bank BR side, a communication pipe 93R extends in the vehicle width direction to make communication of the main fuel injection valves 66R annexed to the throttle bodies 59R. Between the throttle bodies 59F, 59R separated in the vehicle front-rear direction and on the left side in the vehicle width direction, a main fuel injection valve side fuel supply pipe 94 for supplying fuel to the the main fuel injection valves 66F, 66R is provided to extend in the vehicle front-rear direction.

The main fuel injection valve side fuel supply pipe 94 is connected to the main fuel injection valve side branched fuel hose 82 through a joint member 95, and the joint member 95 is arranged to pass through the bracket 70 on the left side.

The joint member 95 is placed to pass through the perforated aperture 72 which, of the plurality of perforated apertures 72 provided in the connecting plate portion 70*a* of the bracket 70 on the left side, is at the forefront. The joint member 95 and the first boss portion 70*b* possessed by the bracket 70 are configured to overlap each other partly at least as viewed in a plan view.

The throttle valves 60F, 60R with which the throttle bodies 59F, 59R are provided respectively are driven by an actuator 97, and a case 98 for the actuator 97 is fastened to a left part on the front bank side throttle body 59F on the left side.

The actuator 97 has an electric motor 96 that generates a power to drivingly turn the throttle valves 60F, 60R. The electric motor 96 is placed to extend in the vehicle width direction ahead of the front bank side throttle bodies 59F which, of the front bank side throttle bodies 59F and the rear bank side throttle bodies 59R separated in the vehicle front-rear direction, is on the front side, and is attached to the case 98 to be housed in the unpurified chamber 48.

In operation, fuel is injected from the main fuel injection valves 66F, 66R into the intake passages 57F, 57R that establish the communication between the intake ports 44F, 44R provided in the cylinder heads 32F, 32R of the engine body 17 and the purified chamber 49 of the air cleaner 42. Fuel is also injected from the secondary fuel injection valves 67F, 67R into the intake passages 57F, 57R on an upper side in stream relative to the main fuel injection valves 66F, 66R in the flow direction in the intake passages 57F, 57R. The secondary fuel injection valves 67F, 67R being one of the main fuel injection valves 66F, 66R and the secondary fuel injection valves 67F, 67R are housed in the purified chamber 49, while the main fuel injection valves 66F, 66R are housed in the unpurified chamber 48 of the air cleaner 42. The common fuel supply hose 80 for leading fuel from the fuel tank 30 to the main fuel injection valves 66F, 66R and the secondary fuel injection valves 67F, 67R in common is connected to the branching connection pipe 81 which is supported to pass through the cleaner case 45 of the air cleaner 42 and the bulkhead 50 and which is placed in one of the unpurified chamber 48 and the purified chamber 49. The branching connection pipe 81 is connected to the main fuel injection valve side branched fuel hose 82 for leading fuel toward the main fuel injection valves 66F, 66R side and the secondary fuel injection valve side branched fuel hose 83 for leading fuel toward the secondary fuel injection valves 67F, 67R side. Thus, the fuel piping can be simplified by containing in the air cleaner 42 the branching connection pipe 81 that distributes fuel to the main fuel injection valves 66F, 66R and the secondary fuel injection valves 67F, 67R. A decrease in the number of parts can be realized by making unnecessary fastening members or the like that secure the branching connection pipe 81 to the cleaner case 45. Furthermore, performing machining to form fastening portions on the cleaner case 45 and the branching connection pipe 81 becomes unnecessary, whereby the manpower and thus cost in machining can be decreased.

Further, the branching connection pipe 81 having the pair of branched pipe portions 81*b*, 81*c* is placed in the unpurified chamber 48, and one 81*b* of both of the branched pipe portions 81*b*, 81*c* passes through the bulkhead 50 and is supported by the bulkhead 50 to open on the purified chamber 49 side. Thus, it is unnecessary to perform machining for fuel piping connection at a part on the purified chamber 49 side of the cleaner case 45, and this contributes to securing the airtightness of the purified chamber 49.

Further, the cleaner case 45 is constructed by combining the lower case half body 46 and the upper case half body 47 which are dividable into upper and lower parts, and the branching connection pipe 81 which is placed in the unpurified chamber 48 defined between the bulkhead 50 and the lower case half body 46 passes through the lower case half body 46 and is connected to the common fuel supply hose 80. Thus, it is unnecessary to perform machining for fuel piping connection at a part on the purified chamber 49 side of the cleaner case 45, and this contributes to securing the airtightness of the purified chamber 49.

Further, the branched pipe portion 81*b* on one side possessed by the branching connection pipe 81 and opening on the purified chamber 49 side is connected by the quick connector 87 to the secondary fuel injection valve side branched fuel hose 83 being the branched fuel conduit that, of the main fuel injection valve side branched fuel hose 82 and the secondary fuel injection valve side branched fuel hose 83, is arranged in the purified chamber 49. Thus, at the time of assembling the air cleaner 42, a tool is not required in connecting the secondary fuel injection valve side branched fuel hose 83 placed in the purified chamber 49 to the branched pipe portion 81*b* opening on the purified chamber 49 side, so that the interior of the purified chamber 49 can be prevented from becoming dirty by using any such tool.

Further, since the grommets 88, 89 being annular elastic seal members are respectively interposed between the branched connection pipe 81, and the cleaner case 45 and the bulkhead 50, the sealing performance at the portions where the branching connection pipe 81 passes through can be ensured. Furthermore, pulsation in fuel pressure can be restrained from being transmitted from the branching connection pipe 81 to the cleaner case 45, so that the generation of vibration at the cleaner case 45 can be suppressed.

Further, at least some of intake passages 57F, 57R that make communication between the purified chamber 49 and the intake ports 44F, 44R are formed by the air funnels 58F, 58R opening to the purified chamber 49 and the throttle bodies 59F, 59R that are arranged in the unpurified chamber 48 and are connected to the downstream end parts of the air funnels 58F, 58R. Thus, a required capacity of the air cleaner 42 can be secured by arranging in the unpurified chamber 48 movable members such as the throttle valves 60F, 60R urged in the throttle bodies 59F, 59R. This contributes to downsizing the whole of the intake device extending from the air cleaner 42 to the cylinder heads 32F, 32R.

Further, the throttle bodies 59F, 59R separated in the vehicle front-rear direction are arranged in the unpurified chamber 48 with themselves mutually coupled by the brackets 70, 71 that are arranged on the lateral sides of the throttle bodies 59F, 59R. The joint member 95 that connects the main fuel injection valve side branched fuel hose 82 to the main fuel injection valve side fuel supply pipe 94 connected to the main fuel injection valves 66F, 66R annexed to the throttle bodies 59F, 59R is arranged to pass through the bracket 70. This makes it easy to perform the connection and separation between the main fuel injection valve side fuel supply pipe 94 and the main fuel injection valve side branched fuel hose 82 at the time of assembling and disassembling. This contributes to simplifying the fuel piping.

Further, the bracket 70 on the left side has the connecting plate portion 70*a* that is fastened to the throttle bodies 59F, 59R separated in the vehicle front-rear direction and arranged on the left side and that is provided with the perforated aperture 72 through which the joint member 95 passes. The first boss portion 70*b* is placed on the throttle bodies 59F, 59R side with respect to the connecting plate portion 70*a* and is consecutively connected to either one of the front and rear parts (the front part in this embodiment) of the connecting plate portion 70*a* and is fastened to the lower part of the cleaner case 45. The second boss portion 70*c* is placed on the opposite side to the throttle bodies 59F, 59R with respect to the connecting plate portion 70*a* and is consecutively connected to the other of the front and rear parts (the rear part in this embodiment) of the connecting plate portion 70*a* and is fastened to the cleaner case 45. The joint member 95 and the first boss portion 70*b* are arranged to overlap each other partly at least as viewed in the plan view. Thus, the region occupied by the first boss portion 70*b* and the region occupied by the joint member 95 are piled up vertically. This makes it possible to avoid an increase in dimension of the cleaner case 45 and at the same time, to secure the space required for performing the fastening operation of the first boss portion 70*b* to the cleaner case 45.

Further, the branching connection pipe 81 is placed at the position where, as viewed in the lateral direction, it overlaps some of the throttle bodies 59R on the rear side of the throttle bodies 59F, 59R separated in the vehicle front-rear direction. The electric motor 96 for generating the power to drivingly turn the throttle valves 60F, 60R respectively possessed by the throttle bodies 59F, 59R is housed in the unpurified chamber 48 to be located ahead of the throttle bodies 59F on the front side of the throttle bodies 59F, 59R separated in the vehicle front-rear direction. Thus, it can be avoided that the air cleaner 42 housing the fuel supply device increases in dimension.

Up to this point, the embodiment according to the present invention has been described, but the present invention is not limited to the aforementioned embodiment and various changes in design can be made without departing from the invention as set forth in claims.

REFERENCE SIGNS LIST

17 . . . Engine body
30 . . . Fuel tank
32F, 32R . . . Cylinder head
42 . . . Air cleaner
44F, 44R . . . Intake port
45 . . . Cleaner case
46 . . . Lower case half body
47 . . . Upper case half body
48 . . . Unpurified chamber
49 . . . Purified chamber
50 . . . Bulkhead
57F, 57R . . . Intake passage
58F, 58R . . . Air funnel
59F, 59R . . . Throttle body
60F, 60R . . . Throttle valve
61 . . . Cleaner element
66F, 66R . . . Main fuel injection valve
67F, 67R . . . Secondary fuel injection valve
70 . . . Bracket
70*a* . . . Connecting plate portion
70*b* . . . First boss portion
70*c* . . . Second boss portion
72 . . . Perforated aperture
80 . . . Common fuel supply hose as common fuel supply conduit
81 . . . Branching connection pipe
81*b*, 81*c* . . . Branched pipe portion
82 . . . Main fuel injection valve side branched fuel hose as main fuel injection valve side branched fuel conduit
83 . . . Secondary fuel injection valve side branched fuel hose as secondary fuel injection valve side branched fuel conduit
87 . . . Quick connector
88, 89 . . . Grommet being elastic seal member
94 . . . Main fuel injection valve side fuel supply pipe
95 . . . Joint member
96 . . . Electric motor
E . . . Engine

The invention claimed is:

1. A fuel supply structure in a vehicle engine, said fuel supply structure comprising:

an air cleaner configured to be divided in a cleaner case by a bulkhead, said bulkhead holding a cleaner element in an unpurified chamber and a purified chamber;

a main fuel injection valve configured to inject fuel into an intake passage that enables communication between an intake port provided in a cylinder head of an engine body and the purified chamber; and a secondary fuel injection valve configured to inject fuel into the intake passage on an upper side relative to the main fuel injection valve in a flow direction in the intake passage, wherein one of the main fuel injection valve and the secondary fuel injection valve is housed in the purified chamber, wherein another of the main fuel injection valve and the secondary fuel injection valve is housed in the unpurified chamber, wherein a common fuel supply conduit configured to lead fuel from a fuel tank to the main fuel injection valve and the secondary fuel injection valve in common is connected to a branching connection pipe which is supported to pass through the cleaner case and the bulkhead and which is disposed in one of the unpurified chamber and the purified chamber, and wherein the branching connection pipe is connected to a main fuel injection valve side branched fuel conduit configured to lead fuel toward the main fuel injection valve side and to a secondary fuel injection valve side branched fuel conduit for leading fuel toward the secondary fuel injection valve side.

2. The fuel supply structure in a vehicle engine according to claim 1, wherein the branching connection pipe includes a pair of branched pipe portions disposed in the unpurified chamber, and wherein one of the branched pipe portions passes through the bulkhead and is supported by the bulkhead to open on a purified chamber side.

3. The fuel supply structure in a vehicle engine according to claim 2, wherein a lower case half body and an upper case half body, being dividable vertically, are combined to constitute the cleaner case, and wherein the branching connection pipe which is disposed in the unpurified chamber defined between the bulkhead and the lower case half body passes through the lower case half body and is connected to the common fuel supply conduit.

4. The fuel supply structure in a vehicle engine according to claim 2, wherein the branched pipe portion on one side possessed by the branching connection pipe and opening on the purified chamber side is connected by a quick connector to the branched fuel conduit which, of the main fuel injection valve side branched fuel conduit and the secondary fuel injection valve side branched fuel conduit, is disposed in the purified chamber.

5. The fuel supply structure in a vehicle engine according to claim 2, wherein annular elastic seal members are respectively interposed between the branching connection pipe, and the cleaner case and the bulkhead.

6. The fuel supply structure in a vehicle engine according to claim 1, wherein at least a part of the intake passage making communication between the purified chamber and the intake port comprises an air funnel opening to the purified chamber and a throttle body disposed in the unpurified chamber and connected to a downstream end part of the air funnel.

7. The fuel supply structure in a vehicle engine according to claim 6, wherein at least two throttle bodies are separated in the vehicle front-rear direction and are disposed in the unpurified chamber, and are mutually coupled by a bracket disposed on a lateral side of the at least two throttle bodies, and wherein a joint member connecting the main fuel injection valve side branched fuel conduit to a main fuel injection valve side fuel supply pipe which is connected to the main fuel injection valves respectively annexed to the throttle bodies is disposed to pass through the bracket.

8. The fuel supply structure in a vehicle engine according to claim 7, wherein the bracket includes a connecting plate portion which is fastened to the at least two throttle bodies separated in the vehicle front-rear direction and which is provided with a perforated aperture making the joint member pass therethrough, a first boss portion which is disposed on the throttle bodies side with respect to the connecting plate portion and which is consecutively connected to either one of front and rear parts of the connecting plate portion to be fastened to a lower part of the cleaner case, and a second boss portion which is disposed on an opposite side to the throttle bodies with respect to the connecting plate portion and which is consecutively connected to the other of the front and rear parts of the connecting plate portion to be fastened to the cleaner case and wherein the joint member and the first boss portion are disposed to at least partially overlap as viewed in a plan view.

9. The fuel supply structure in a vehicle engine according to claim 6, wherein the branching connection pipe is disposed at a position where, as viewed laterally, it overlaps a part of the throttle body on a rear side of the throttle bodies separated in the vehicle front-rear direction, and wherein an electric motor configured to generate a power to drivingly turn throttle valves respectively provided in the throttle bodies is housed in the unpurified chamber to be placed ahead of the throttle body on a front side of the at least two throttle bodies separated in the vehicle front-rear direction.

10. A fuel supply structure in a vehicle engine, said fuel supply structure comprising:

air cleaner means for cleaning air, said air cleaner means being divided in a cleaner case means by a bulkhead, said bulkhead holding cleaner element means in an unpurified chamber and a purified chamber;

main fuel injecting means for injecting fuel into an intake passage that enables communication between an intake port in a cylinder head of an engine body and the purified chamber;

secondary fuel injection means for injecting fuel into the intake passage on an upper side relative to the main fuel injection means in a flow direction in the intake passage, wherein one of the main fuel injection means and the secondary fuel injection means is housed in the purified chamber, wherein another of the main fuel injection means and the secondary fuel injection means is housed in the unpurified chamber, wherein a common fuel supply means for leading fuel from a fuel tank to the main fuel injection means and the secondary fuel injection means in common is connected to a branching connection pipe means which is supported to pass through the cleaner case means and the bulkhead and which is disposed in one of the unpurified chamber and the purified chamber, and wherein the branching connection pipe means is connected to a main fuel injection means side branched fuel conduit means for leading fuel toward the main fuel injection means side and to a secondary fuel injection means side branched fuel conduit means for leading fuel toward the secondary fuel injection means.

11. The fuel supply structure in a vehicle engine according to claim 10, wherein the branching connection pipe means includes a pair of branched pipe portions disposed in the unpurified chamber, and wherein one of the branched pipe portions passes through the bulkhead and is supported by the bulkhead to open on a purified chamber side.

12. The fuel supply structure in a vehicle engine according to claim 11, wherein a lower case half body means and an upper case half body means are vertically dividable and are combined to form the cleaner case means, and wherein the branching connection pipe means which is disposed in the unpurified chamber defined between the bulkhead and the lower case half body means passes through the lower case half body means and is connected to the common fuel supply means.

13. The fuel supply structure in a vehicle engine according to claim 11, wherein the branched pipe portion means on one side possessed by the branching connection pipe means and opening on the purified chamber side is connected by quick connector means to the branched fuel conduit means which, of the main fuel injection means side branched fuel conduit means and the secondary fuel injection valve side branched fuel conduit means is disposed in the purified chamber.

14. The fuel supply structure in a vehicle engine according to claim 11, further comprising annular elastic seal means for sealing, said annular elastic seal means being interposed between the branching connection pipe means, the cleaner case means, and the bulkhead.

15. The fuel supply structure in a vehicle engine according to claim 10, wherein at least a part of the intake passage making communication between the purified chamber and the intake port comprises air funnel means for funneling air, said air funnel means opening to the purified chamber, and throttle body means for throttling, said throttle body means being disposed in the unpurified chamber and connected to a downstream end part of the air funnel means.

16. The fuel supply structure in a vehicle engine according to claim 15, further comprising at least two throttle body means being separated in the vehicle front-rear direction, said at least two throttle body means being disposed in the unpurified chamber, and are mutually coupled by a bracket disposed on a lateral side of the at least two throttle body means, wherein a joint member connected the main fuel injection means side branched fuel conduit means to a main fuel injection means side fuel supply pipe connected to the main fuel injection means respectively annexed to the at least two throttle body means is disposed to pass through the bracket.

17. The fuel supply structure in a vehicle engine according to claim 16, wherein the bracket includes a connecting plate portion which is fastened to the at least two throttle body means separated in the vehicle front-rear direction, and is provided with a perforated aperture making the joint member pass therethrough, wherein a first boss portion is disposed on the at least two throttle body means side with respect to the connecting plate portion, and being consecutively connected to either one of front and rear parts of the connecting plate portion to be fastened to a lower part of the cleaner case means, and wherein a second boss portion is disposed on an opposite side to the at least two throttle body means with respect to the connecting plate portion and which is consecutively connected to the other of the front and rear parts of the connecting plate portion to be fastened to the cleaner case, and wherein the joint member and the first boss portion are disposed to at least partially overlap as viewed in a plan view.

18. The fuel supply structure in a vehicle engine according to claim 15, wherein the branching connection pipe means is disposed at a position where, as viewed laterally, it overlaps a part of the throttle body means on a rear side of the at least two throttle body means separated in the vehicle front-rear direction, and wherein electric motor means for generating power to drivingly turn throttle valves respectively provided in the at least two throttle body means is housed in the unpurified chamber to be placed ahead of the throttle body means on a front side of the at least two throttle body means separated in the vehicle front-rear direction.

* * * * *